US007448369B2

(12) United States Patent
Robinson et al.

(10) Patent No.: US 7,448,369 B2
(45) Date of Patent: Nov. 11, 2008

(54) METHOD FOR CONTROLLING A FUEL INJECTOR

(75) Inventors: James S. Robinson, Delaware, OH (US); Todd R. Luken, Dublin, OH (US); Jared C. Vanderhoof, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/549,015

(22) Filed: Oct. 12, 2006

(65) Prior Publication Data

US 2008/0087250 A1 Apr. 17, 2008

(51) Int. Cl.
*F02D 41/18* (2006.01)
*F02D 41/00* (2006.01)

(52) U.S. Cl. ..... 123/681; 701/104

(58) Field of Classification Search ..... 123/478, 123/480, 494, 681, 445; 701/103, 104
See application file for complete search history.

(56) References Cited

U.S. PATENT DOCUMENTS 4,155,332 A 5/1979 Yaegashi et al.
4,332,226 A 6/1982 Nomura et al.
4,336,782 A 6/1982 Endo et al.
4,389,996 A * 6/1983 Yaegashi et al. ..... 123/478
4,413,602 A 11/1983 Inoue et al.
4,450,814 A 5/1984 Sawamoto et al.
4,549,518 A 10/1985 Koumura
4,644,474 A * 2/1987 Aposchanski et al. ..... 123/494
4,709,334 A 11/1987 Abe et al.
4,957,083 A 9/1990 Nakaniwa et al.
6,272,427 B1 8/2001 Wild et al.

* cited by examiner

*Primary Examiner*—Mahmoud Gimie
(74) *Attorney, Agent, or Firm*—Plumsea Law Group, LLC; Mark E. Duell

(57) ABSTRACT

A method of controlling a fuel injector is disclosed. Multiple airflow rate regimes are associated with different fuel injection control methods. In one example, a low airflow rate regime is associated with a speed density control method and a high airflow rate regime is associated with an airflow meter control method.

21 Claims, 4 Drawing Sheets

METHOD FOR CONTROLLING A FUEL INJECTOR

BACKGROUND OF THE INVENTION

1. Field of the Invention

The present invention relates to motor vehicles and in particular to a method for controlling a fuel injector.

2. Description of Related Art

Methods of controlling a fuel injector have been previously proposed. Yaegashi et al. (U.S. Pat. No. 4,155,332) teaches an electric fuel injection system in an internal combustion engine. In the design of Yaegashi, a fuel control circuit operates a valve type injector. Yaegashi discloses a system for controlling a fuel injection based on information sent to a fuel control circuit via wires from an air flow meter, a pressure detector and an engine speed sensor.

In particular, an air intake value is measured using an air flow meter, and then compared with a pre-determined air intake quantity. If the air intake value is below the pre-determined value, the fuel injection quantity is calculated on the basis of the output signal from the air flow meter. If the air intake value is above the pre-determined value, the fuel injection quantity is calculated on the basis of the signal from a pressure detector and the engine speed sensor. A thermo sensor and an oxygen sensor are also are also connected to the fuel control circuit.

The operating logic of the system proceeds as follows: the intake air quantity is stored as datum W. Following this, the engine revolution count is stored as datum N. If W is greater than a pre-determined intake value Wa, then the injection quantity is calculated as W/N. Otherwise, the intake manifold pressure is stored as datum P and the calculation for the injection quantity is made based on P (manifold pressure).

While Yaegashi teaches an electronic fuel injection system that is responsive to an air flow quantity, the engine speed and the intake manifold pressure, Yaegashi fails to teach a fuel injection system that switches between a control method based on information from an air flow meter and a speed density control method. Yaegashi also fails to teach a fuel injection system capable of switching between more than two airflow control regimes.

Inoue et al. (U.S. Pat. No. 4,413,602) discloses a fuel injection control apparatus for an internal combustion engine. The fuel injection control apparatus of Inoue uses a first basic fuel injection signal for light load and a second fuel injection signal for heavy load. The fuel injection control apparatus includes multiple sensors: a throttle valve position sensor, a manifold pressure sensor and an engine pulse sensor. In the Inoue system, the engine load condition (light and heavy) is decided based on signals received at a selector by the throttle valve position sensor. Specifically, if the throttle valve angle is below a preset level, the engine load is defined as light. If the throttle valve angle is above a preset level, the engine load is defined as heavy.

When the engine is determined to be in light load, the basic fuel injection signal is determined based on the manifold pressure received by the manifold pressure sensor. Alternatively, when the engine is determined to be in heavy load condition, the basic fuel injection signal is determined based on the revolution number and the throttle valve angle as received from the engine pulse sensor and the throttle valve position sensor, respectively. Inoue also teaches a design in which the engine load condition is determined by the manifold pressure.

Inoue, however, does not teach a fuel injection control apparatus that uses an air flow meter for determining the fuel injection signal in some situations. Inoue does not teach a fuel injection control apparatus with a temperature sensor. Inoue also fails to teach or render obvious the concept of more than two engine loads.

Sawamoto (U.S. Pat. No. 4,450,814) teaches an air-fuel ratio control apparatus. Specifically, Sawamoto's design is directed at an internal combustion engine with a turbocharger. The air-fuel ratio control apparatus selects between two methods for calculating a fuel injection quantity based an intake vacuum pressure parameter.

Normally, the controller controls the amount of fuel injected according to input received by an air flow meter and ignition coils (which sense engine speed). If the intake vacuum pressure as measured by the pressure sensor is higher than a pre-determined value, the fuel quantity is then calculated from the engine speed only.

While Sawamoto does teach an air-fuel ratio control apparatus with two distinct methods for calculating a fuel injection quantity, Sawamoto fails to teach an apparatus that incorporates a temperature sensor within the intake manifold for facilitating the calculation of the fuel quantity. Additionally, Sawamoto fails to teach more than two regimes of air flow where different methods of calculating a fuel injection quantity may be applied. Finally, Sawamoto fails to teach an apparatus in which the transition criteria is based on multiple factors (such as throttle valve angle and engine speed in addition to intake manifold pressure).

SUMMARY OF THE INVENTION

A method for controlling a fuel injector is disclosed. Generally, these methods can be used in connection with an engine of a motor vehicle. The invention can be used in connection with a motor vehicle. The term "motor vehicle" as used throughout the specification and claims refers to any moving vehicle that is capable of carrying one or more human occupants and is powered by any form of energy. The term motor vehicle includes, but is not limited to cars, trucks, vans, minivans, SUV's, motorcycles, scooters, boats, personal watercraft, and aircraft.

In some cases, the motor vehicle includes one or more engines. The term "engine" as used throughout the specification and claims refers to any device or machine that is capable of converting energy. In some cases, potential energy is converted to kinetic energy. For example, energy conversion can include a situation where the chemical potential energy of a fuel or fuel cell is converted into rotational kinetic energy or where electrical potential energy is converted into rotational kinetic energy. Engines can also include provisions for converting kinetic energy into potential energy, for example, some engines include regenerative braking systems where kinetic energy from a drivetrain is converted into potential energy. Engines can also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

In one aspect, the invention provides a fuel injection system associated with an engine, comprising: a fuel injector; an electronic control unit in communication with an airflow meter and in communication with a sensor associated with an intake manifold of the engine; the electronic control unit also receiving information related to an airflow rate of the engine; the electronic control unit using the sensor associated with the intake manifold in a low airflow rate regime; and where the electronic control unit uses the airflow meter in a high air flow regime.

In another aspect, the sensor associated with the intake manifold is a pressure sensor.

In another aspect, the pressure sensor is a manifold absolute pressure sensor.

In another aspect, a temperature sensor is associated with the intake manifold.

In another aspect, an engine speed sensor is in communication with the electronic control unit.

In another aspect, a throttle valve sensor is in communication with the electronic control unit.

In another aspect, the invention provides a method of controlling a fuel injection system, comprising the steps of: receiving information from a set of sensors; determining an airflow rate based on information received from at least one sensor; sending a first control signal to the fuel injector when the airflow rate is within a first airflow rate regime and sending a second control signal to the fuel injector when the airflow rate is within a second airflow rate regime; the first airflow rate regime being lower than the second airflow rate regime; and where the first control signal is associated with a speed density control method and the second control signal is associated with an airflow meter control method.

In another aspect, the set of sensors includes a pressure sensor associated with the speed density control method.

In another aspect, the set of sensors includes an ambient pressure sensor associated with the speed density control method.

In another aspect, the set of sensors includes a temperature sensor associated with the speed density control method.

In another aspect, the set of sensors includes an air flow meter associated with the airflow meter control method.

In another aspect, the airflow meter control method may be optimized for various airflow rates.

In another aspect, the airflow meter control method may be optimized for high airflow rates.

In another aspect, the invention provides a method of selecting an injection control method, comprising the steps of: dividing a range of possible airflow rates into a first airflow rate regime, a second airflow rate regime and a third airflow rate regime, the second airflow rate regime being disposed between the first airflow rate regime and the third airflow rate regime; associating a first fuel injection control method with the first airflow rate regime and the third airflow rate regime; associating a second fuel injection control method with the second airflow rate regime; determining an airflow rate based on information received by a set of sensors; sending a first control signal associated with the first fuel injection control method to the fuel injector when the airflow rate is within the first airflow rate regime or the third airflow rate regime; and sending a second control signal associated with the second fuel injection control method to the fuel injection when the airflow rate is within the second airflow rate regime.

In another aspect, the first airflow rate regime is a low airflow rate regime.

In another aspect, the third airflow rate regime is a high airflow rate regime.

In another aspect, the first fuel injection control method is a speed density control method.

In another aspect, the second fuel injection control method is an airflow meter control method.

In another aspect, the set of sensors includes a pressure sensor, a temperature sensor and an ambient pressure sensor associated with the speed density control method.

In another aspect, the set of sensors includes an airflow meter associated with the airflow meter control method.

In another aspect, the airflow meter control method may be optimized for high airflow rates.

In another aspect, the set of sensors includes an airflow meter.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
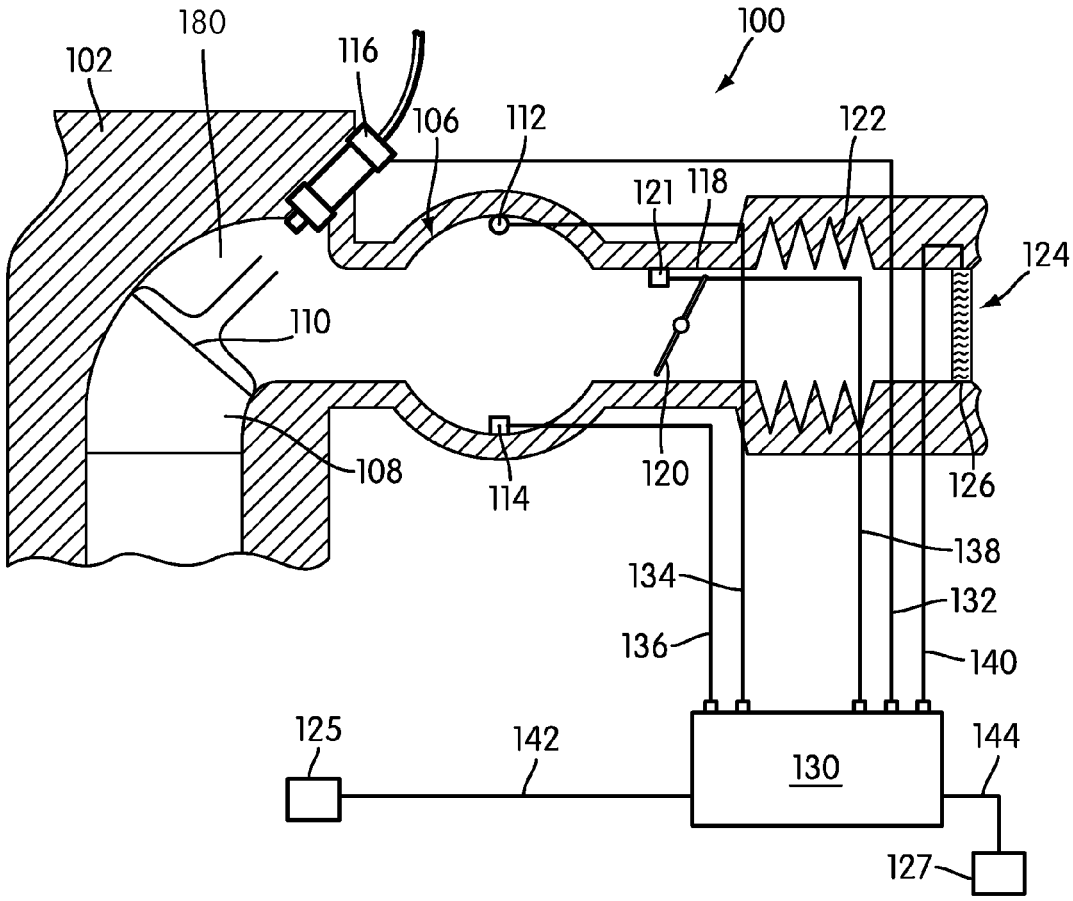
FIG. 1 is a schematic view of a preferred embodiment of a fuel injection system.

FIG. 1 is a schematic view of a preferred embodiment of fuel injection system 100. Preferably, fuel injection system 100 may include engine 102. For the purposes of clarity, engine 102 is shown in FIG. 1 as a portion of an engine. Generally, engine 102 may be any kind of engine, including, but not limited to a piston engine, a four stroke engine, a two stroke engine, a turbocharged engine, a gasoline engine, a diesel engine, a rotary engine, as well as other kinds of engines. In some embodiments, engine 102 may be a hybrid engine. Additionally, engine 102 may comprise multiple engines.

In some embodiments, fuel injection system 100 may include provisions for introducing air to engine 102. In some embodiments, engine 102 may associated with intake manifold 106. Preferably, intake manifold 106 may be disposed adjacent to compression chamber 108 of engine 102. In particular, intake manifold 106 may be disposed adjacent to intake valve 110.

Generally, fuel injection system 100 may include provisions for determining properties of the air disposed within intake manifold 106 and introduced to engine 102. In some embodiments, intake manifold 106 may include various sensors. In a preferred embodiment, intake manifold 106 may include provisions for determining the pressure within intake manifold 106. Also, intake manifold 106 preferably includes provisions for determining the temperature associated with intake manifold 106.

Preferably, intake manifold 106 includes pressure sensor 112. In some embodiments, pressure sensor 112 may be disposed within intake manifold 106. Generally, pressure sensor 112 may be any device that measures the pressure within intake manifold 106. In a preferred embodiment, pressure sensor 112 may be a manifold absolute pressure sensor (MAP-sensor).

In some embodiments, intake manifold 106 may include provisions for determining the temperature of air disposed within intake manifold 106. In some embodiments, intake manifold 106 may include temperature sensor 114. Preferably, temperature sensor 114 is disposed within intake manifold 106. In a preferred embodiment, temperature sensor 114 may be disposed across from pressure sensor 112 within intake manifold 106.

Preferably, fuel injection system 100 includes provisions for injecting fuel into engine 102. In some embodiments, engine 102 may be associated with injector 116. In some embodiments, injector 116 may be associated with intake manifold 106. In some embodiments, injector 116 may be disposed within intake manifold 106. Additionally, injector 116 may be disposed adjacent to intake valve 110.

Preferably, fuel injection system 100 may include provisions for controlling the amount of airflow into intake manifold 106. In some embodiments, fuel injection system 100 preferably includes throttle body 118. In some embodiments, throttle body 118 may be disposed adjacent to intake manifold 106. Additionally, throttle body 118 is preferably adjacent to air intake duct 122.

Generally, throttle body 118 preferably includes throttle valve 120. Throttle valve 120 preferably opens and closes in a manner that changes the airflow rate into intake manifold 106. In a preferred embodiment, throttle body 118 includes throttle valve sensor 121. Preferably, throttle valve sensor 121 may be configured to measure the angle of throttle valve 120 as measured from an initial position.

In some embodiments, fuel injection system 100 may include air entry port 124. The term air entry port refers to any mechanism for allowing air to enter fuel injection system 100 adjacent to air intake duct 122. In some embodiments, air entry port 124 preferably includes airflow meter 126. In a preferred embodiment, airflow meter 126 may be a mass airflow sensor.

Generally, fuel injection system 100 may include provisions for measuring the engine speed. In some embodiments, fuel injection system 100 may include engine speed sensor 125. Preferably, engine speed sensor 125 may be associated with engine 102. Engine speed sensor 125 may be disposed along a portion of engine 102 not shown in this schematic illustration.

Additionally, fuel injection system 100 may include provisions for measuring an ambient pressure outside of engine 102 and intake manifold 106. Preferably, fuel injection system 100 may include ambient pressure sensor 127. Generally, ambient pressure sensor 127 may be disposed away from engine 102 or intake manifold 106 and in a position suitable to measure the ambient pressure.

Preferably, fuel injection system 100 may include provisions for controlling injector 116. In some embodiments, fuel injection system 100 may include electronic control unit 130 (referred to from here on as ECU 130). In some embodiments, ECU 130 may be a computer of some type configured to control injector 100.

In some embodiments, ECU 130 may be associated with fuel injector 116, pressure sensor 112, temperature sensor 114, throttle valve sensor 121, engine speed sensor 125, airflow meter 126 and ambient pressure sensor 127. Preferably, ECU 130 may be in communication with fuel injector 116, pressure sensor 112, temperature sensor 114, throttle valve sensor 121 and airflow meter 126. In some cases, ECU 130 may communicate with various devices by using electrical connections. Specifically, ECU 130 may be connected to fuel injector 116 by first connection 132. In a similar manner, ECU 130 may be connected to pressure sensor 112 by second connection 134. In a similar manner, ECU 130 may be connected to temperature sensor 114 by third connection 136. In a similar manner, ECU 130 may be connected to throttle valve sensor 121 by fourth connection 138. Likewise, ECU 130 may be connected to airflow meter 126 by fifth connection 140. In a similar manner, ECU 130 may be connected to engine speed sensor 125 by sixth connection 142. Finally, ECU 130 may be connected to ambient pressure sensor 127 by seventh connection 144. The various connections could be electrical, optical or wireless.

Using this configuration, one embodiment of fuel injection system 100 and engine 102 operates by the following preferred steps. First, air is received at air intake port 124. Preferably, the mass of the air entering at air intake port 124 is measured by airflow meter 126. This information is relayed to ECU 130 by means of fifth electrical connection 140.

Once air has passed through airflow meter 126, the air enters air intake duct 122. For schematic purposes, air intake duct 122 is shown in FIG. 1 as being short, however, air intake duct 122 may have any desired length. From air intake duct 122, air preferably passes through throttle body 118 by way of throttle valve 120. At this stage, the angle of throttle valve 120 may be determined by throttle valve sensor 121 and relayed to ECU 130 by way of fourth electrical connection 138.

Generally, throttle valve 120 controls the amount of air that enters intake manifold 106. The larger the angle of throttle valve 120, the larger the quantity of air that is permitted to enter intake manifold 106 from air duct 122. As air moves through intake manifold 106, the pressure and temperature are determined by pressure sensor 112 and temperature sensor 114, respectively. These measured values are preferably relayed to ECU 130 through connections 134 and 136.

Finally, the air disposed within intake manifold 106 may flow through port 180 into compression chamber 108 as intake valve 110 opens. Simultaneously, injector 116 may inject a quantity of fuel as the air flows past port 180 and into compression chamber 108. Preferably, the amount of fuel injected using injector 116 may be controlled by ECU 130. Specifically, ECU 130 calculates an injection amount based on inputs received by pressure sensor 112, temperature sensor 114, throttle valve sensor 121 and airflow meter 126.

Preferably, fuel injection system 100 may include provisions for optimizing fuel injection for low airflow rate conditions and high airflow rate conditions. In some embodiments, fuel injection system 100 includes more than one method for determining the injection amount dispensed by injector 116. In a preferred embodiment, fuel injection system 100 may include a first control method and a second control method. Each control method may be used to determine an appropriate fuel injection amount. In a preferred embodiment, the first control method may be a speed density control method. Generally, the speed density control method uses information gathered by pressure sensor 112, temperature sensor 114 and ambient pressure sensor 127. Additionally, the second control method may preferably be an airflow meter (AFM) control method, where the primary sensor used is airflow meter 126. For each method, ECU 130 may calculate a fuel injection quantity based on algorithms using the input parameters from the sensors associated with each control method.

Figure 2:
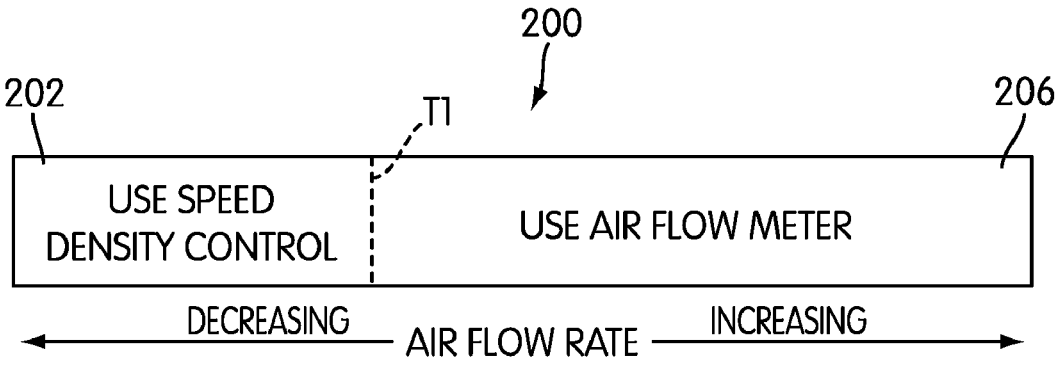
FIG. 2 is a schematic representation of a preferred embodiment of two airflow rate regimes.

FIG. 2 is a schematic diagram 200 of an airflow rate range with two airflow rate regimes. Low airflow rate regime 202, may be associated with the speed density control method.

This configuration may be useful as the speed density method is preferable at speeds close to idling. Likewise, high airflow rate regime 206 may be associated with the airflow meter control method. Using this configuration, the AFM control method may be optimized for higher speeds. This configuration may be preferable over configurations using only a single fuel injection control method for both high and low airflow rates. Preferably, transition airflow rate T1 represents the airflow value where the two regimes 202 and 206 meet.

Figure 3:
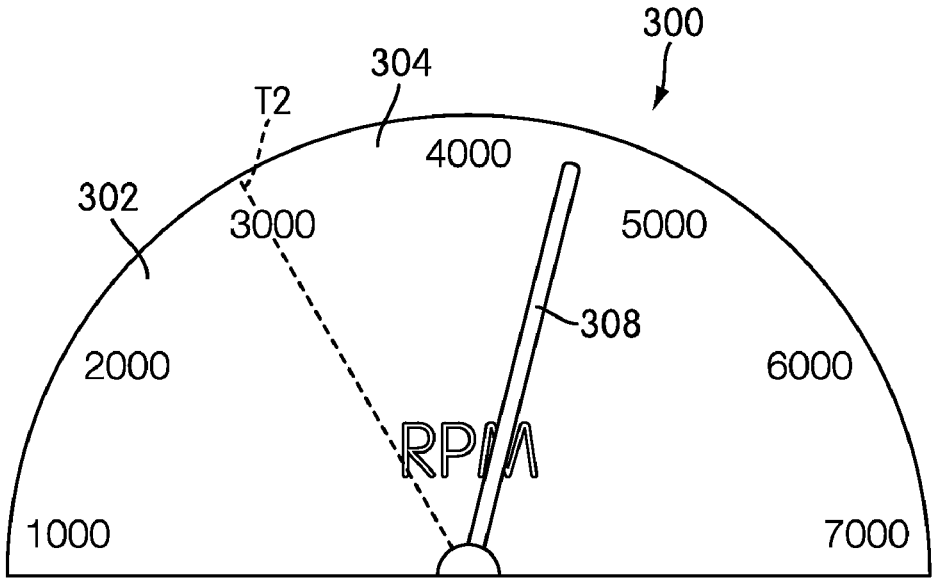
FIG. 3 is a schematic view of a preferred embodiment of an RPM meter.

In some cases, the airflow rate may be related to the speed of the engine in terms of revolutions per minute (RPM). FIG. 3 is a schematic representation of tachometer 300. In this embodiment, the speed density control method may be associated with a low RPM range, shown as first regime 302. Likewise, the airflow meter control method may be associated with a high RPM range, shown as second regime 304. Transition RPM value T2 represents the RPM value where the two regimes 302 and 304 meet. Generally, indicator 308 is associated with the current engine speed.

In this embodiment, indicator 308 is disposed within second regime 304. Therefore, the second control method, the airflow meter control method, is used to determine the injection quantity. The system preferably uses the first control method, or speed density control method, during low airflow conditions. These lower airflow conditions generally correspond with lower RPM ranges. In the embodiment shown in FIG. 3, the low RPM range, or first regime 302, is below about 3000 RPM.

The previous embodiments are only meant to be illustrative of the ways that airflow rate regimes may be defined. In some embodiments, a fuel injection system may include provisions for distinguishing between two airflow rate regimes based on multiple criteria. In some embodiments, the transitional airflow rate may be determined by a theoretical estimate that is predetermined by the ECU. In other embodiments, the transitional airflow rate may be determined by a predetermined threshold associated with an airflow meter. In some embodiments, the transitional airflow rate may be identified as the value where the airflow meter control method becomes accurate. In a preferred embodiment, airflow rate regimes are distinguished based on information measured by an engine speed sensor, an intake manifold pressure sensor and a throttle valve sensor. These parameters are generally speed density control parameters.

Figure 4:
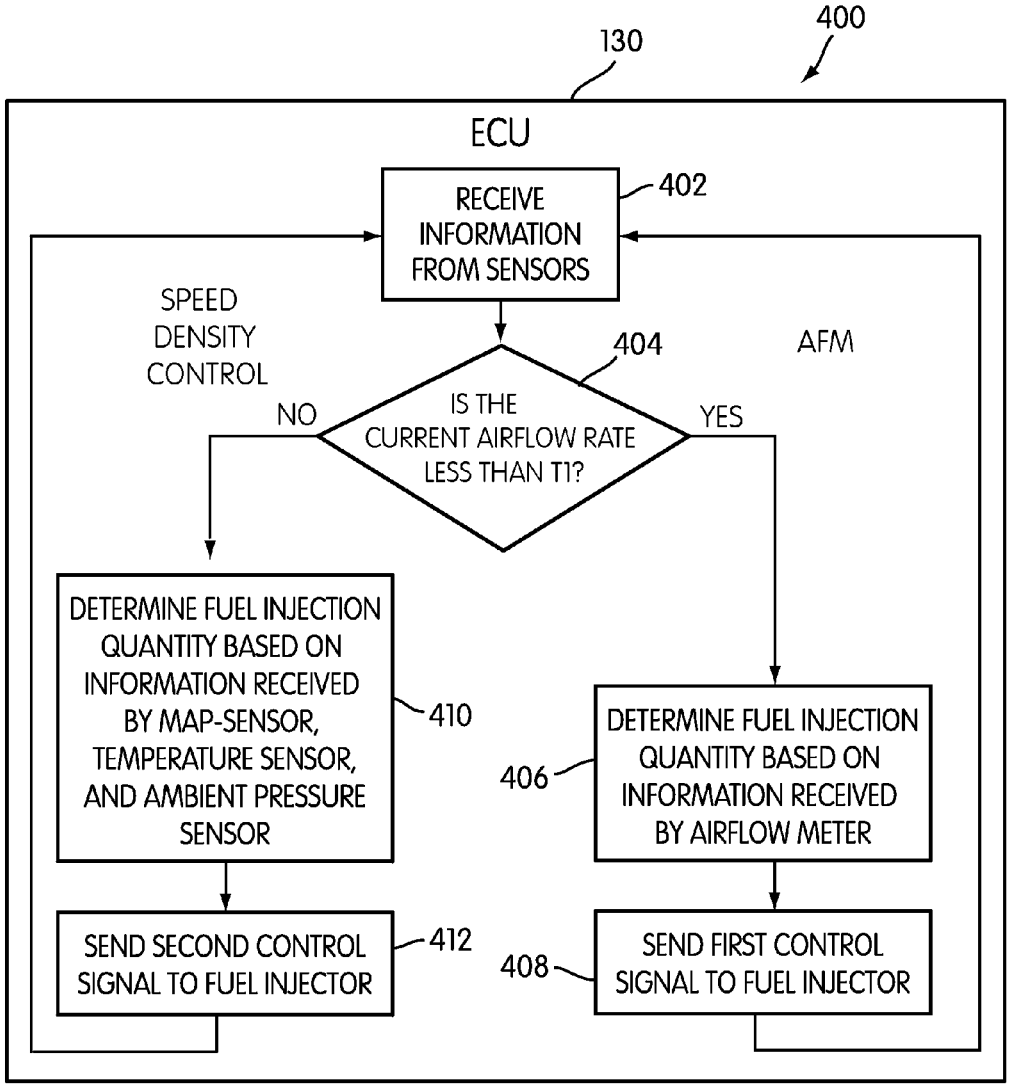
FIG. 4 is a preferred embodiment of a flow chart of the process of selecting a fuel injection control method.

FIG. 4 is a preferred embodiment of process 400 performed by ECU 130 for selecting between two fuel injection control methods. During step 402, information is received from various sensors. In a preferred embodiment, information is received from pressure sensor 112, temperature sensor 114, throttle valve sensor 121, engine speed sensor 125, airflow meter 126 and ambient pressure sensor 127 (see FIG. 1).

Also during step 404, ECU 130 preferably determines various engine parameters as measured by various sensors. During this step, throttle angle TH is determined by information received from throttle valve sensor 121. Additionally, engine speed NE is determined by information received from engine speed sensor 125. Also, intake manifold pressure PBA is determined by information received by manifold pressure sensor 112.

During step 404, the current airflow rate is compared with a predetermined transition airflow rate. In some embodiments, this transition airflow rate may be transition airflow rate T1. Preferably, T1 is a fixed value that may be preset within ECU 130 by the manufacturer.

Generally, the current airflow rate airflow may be determined by considering various sensory information received by ECU 130 during step 404. In a preferred embodiment, the current airflow rate may be determined by considering throttle angle TH, engine speed NE, and intake manifold pressure PBA. In particular, the current airflow rate may be a function of throttle angle TH, engine speed NE and intake manifold pressure PBA. In other embodiments, other sensory information may be used to determine the current airflow rate.

If the current airflow rate is greater than transition airflow rate T1, then the first control method is selected. In this case, ECU 130 preferably proceeds to step 406. Preferably, during step 406, the quantity of fuel to be injected using injector 116 is determined based on sensory information received from airflow meter 126. Once a first fuel injection quantity Q1 is determined, ECU 130 sends a first control signal to fuel injector 116 to execute injection of quantity Q1 during step 408. Following step 408, this process is repeated as new sensory information is received by ECU 130 during step 402.

If the current airflow rate is less than transition airflow rate T1, then the second control method is selected. In the case where the second control method is selected, the speed density control method, ECU 130 preferably proceeds to step 410. Preferably, during step 410, the quantity of fuel to be injected using injector 116 is determined based on sensory information received from manifold pressure sensor 112, temperature sensor 114 and ambient pressure sensor 125. Once a second fuel injection quantity Q2 is determined, ECU 130 sends a control signal to fuel injector 116 to execute injection of quantity Q2 during step 412. Following step 412, this process is repeated as new sensory information is received by ECU 130 during step 402.

In the previous embodiment, only two airflow rate regimes were considered. Preferably, a fuel injection system may include provisions for selecting between two control methods over multiple airflow rate regimes. In other words, in some embodiments, there may be more than two airflow rate regimes. Also, in some embodiments, there may be up to five airflow rate regimes.

Figure 5:
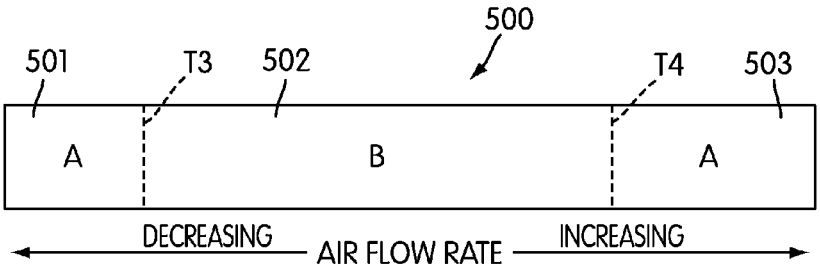
FIG. 5 is a schematic representation of a preferred embodiment of three airflow rate regimes.

FIG. 5 is a schematic diagram of airflow rate scale 500 with three distinct airflow rate regimes. In particular, airflow scale 500 preferably includes first airflow rate regime 501, second airflow rate regime 502 and third airflow rate regime 503. Generally, first airflow rate regime 501 and second airflow rate regime 502 may be divided by transition airflow rate T3. Likewise, second airflow rate regime 502 and third airflow rate regime 503 are preferably separated by transition airflow rate T4.

In this embodiment, each airflow rate regime may be associated with one of two possible fuel injection control methods: control method A and control method B. First airflow rate regime 501 may be associated with control method A, and second airflow rate regime 502 may be associated with control method B. Finally, third airflow rate regime 503 may be associated with control method A.

Generally, control method A uses input from different sensors than control method B in order to calculate a fuel injection quantity. In a preferred embodiment, control method A is used to calculate a fuel injection quantity based on speed density control. As discussed previously, speed density control determines a fuel injection quantity on the basis of information received from a manifold pressure sensor, an ambient pressure sensor, and a temperature sensor. Control method B is preferably used to calculate a fuel injection quantity based on information received from an airflow meter. In other embodiments, however, control method A and control method B may use other fuel injection control methods besides speed density control or AFM.

Figure 6:
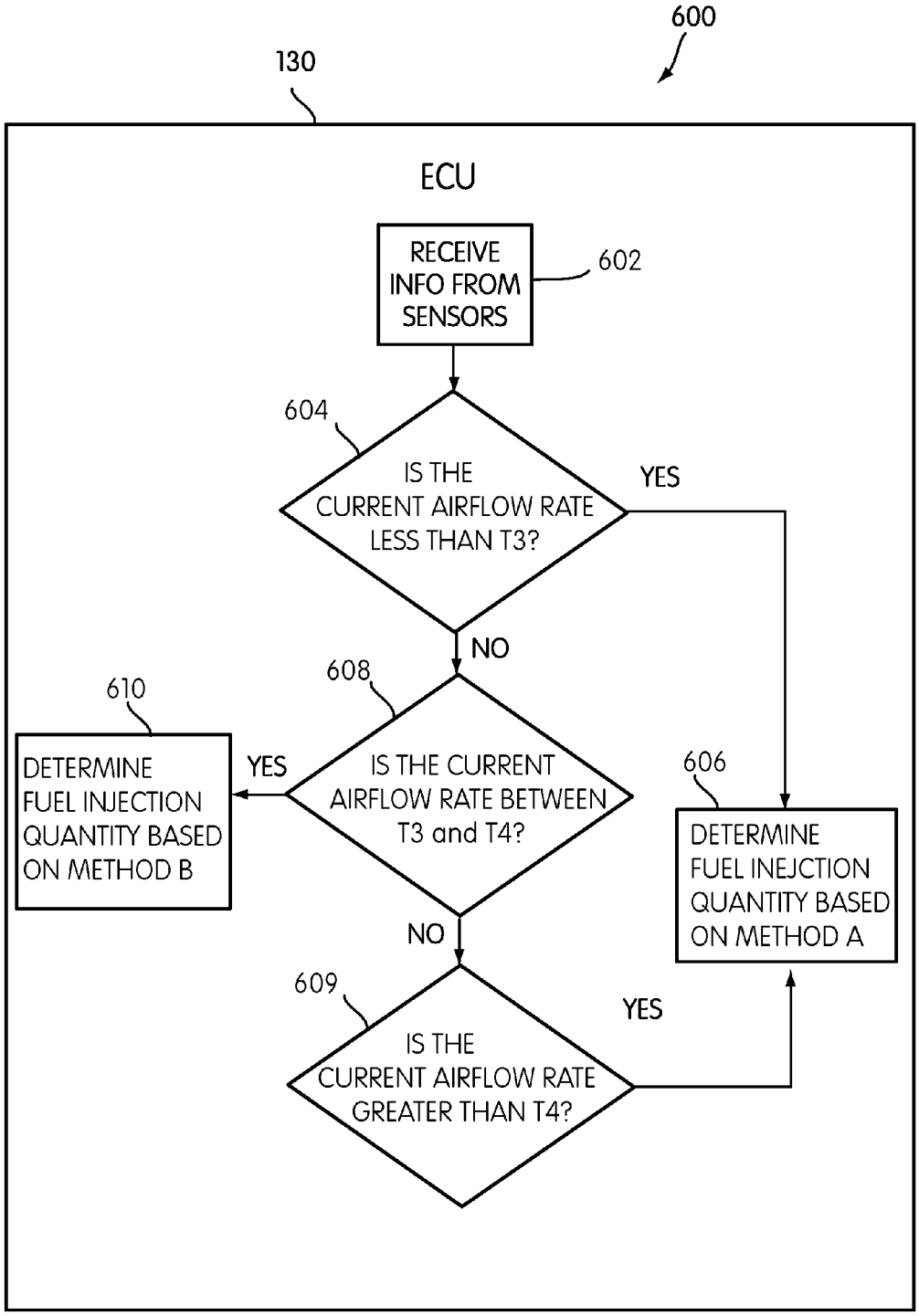
FIG. 6 is a preferred embodiment of a flow chart of the process of selecting a fuel injection control method.

FIG. 6 is a preferred embodiment of process 600 used to determine a suitable fuel injection quantity. Preferably, process 600 may be representative of the process used by ECU 130 to determine the fuel injection control method to be used. At step 602, ECU 100 receives input from a preconfigured set of sensors. In a preferred embodiment, fuel injection system 100 includes the same configuration of sensors seen in FIG. 1. In particular, ECU 130 preferably receives information from manifold pressure sensor 112, temperature sensor 114, throttle valve sensor 121, engine speed sensor 125, airflow meter 126 and ambient pressure sensor 127.

During step 602, a current airflow rate is calculated. The current airflow rate may be determined by a number of different parameters. In some embodiments, the parameters used to determine the current airflow rate may include the intake manifold pressure PBA, the throttle valve angle TH and the engine speed NE. Following step 602, the current airflow rate is compared with transition airflow rate T3, during step 604.

If the current airflow rate is less than transition airflow rate T3, ECU 130 proceeds to step 606. In this case, the current airflow rate has been determined to be within first regime 501. During step 606, ECU 130 preferably determines a fuel injection quantity based on fuel control method A. Control method A, as discussed here, may be any type of fuel injection control method. In a preferred embodiment, as previously discussed, control method A may be a speed density control method. In this case, the fuel injection quantity will be determined based on information received from manifold pressure sensor 112, ambient pressure sensor 127 and engine speed sensor 125.

If, during step 604, the current airflow rate is determined to be above transition airflow rate T3, ECU 130 preferably proceeds to step 608. During step 608, the current airflow rate is compared to transition airflow rate T3 and transition airflow rate T4. In cases where the current airflow rate is less than transition airflow rate T4 and greater than transition airflow rate T3, ECU 130 preferably proceeds from step 608 to step 610. In this case, the current airflow rate is determined to be within second airflow rate regime 502. During step 610, ECU 130 preferably determines the fuel injection quantity based on control method B. Generally, control method B may be any fuel injection control method. In a preferred embodiment, control method B may be associated with an airflow meter. In particular, control method B may be a method for calculating the fuel injection quantity on the basis of information received from airflow meter 126.

If, during step 608, the current airflow rate is determined to be greater than transition airflow rate T4, ECU 130 proceeds to step 609. During step 609, the current airflow rate is determined to be greater than transition airflow rate T4. At this point, ECU 130 proceeds to step 606. The details of step 606 have been previously discussed. In this case, the current airflow rate has been determined to be within third airflow rate regime 503. Third airflow rate regime 503 is also preferably associated with control method A.

Following steps 606 and 610, ECU 130 preferably sends a control signal to fuel injector 116. Following this step, the whole process may be repeated again. The amount of time it takes for ECU 130 to perform steps 602, 604, 606, 608 and 610 may vary.

In other embodiments, an airflow rate scale may include more than three airflow rate regimes. Generally, an airflow rate scale may include any number of airflow rate regimes. Furthermore, there may be more than two fuel injection control methods associated with the multiple airflow rate regimes. In this manner, a fuel injection control system may be optimized over many different airflow rate regimes.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A fuel injection system associated with an engine, comprising:

a fuel injector;

an electronic control unit in communication with an airflow meter and in communication with a pressure sensor associated with an intake manifold of the engine;

the electronic control unit also receiving information related to an airflow rate of the engine;

the electronic control unit using the pressure sensor associated with the intake manifold in a low airflow rate regime;

wherein the electronic control unit uses the airflow meter in a high air flow regime; and wherein the electronic control unit determines whether to use the pressure sensor or the airflow meter by considering data consisting essentially of the airflow rate of the engine.

2. The fuel injection system according to claim 1, wherein the pressure sensor is a manifold absolute pressure sensor.

3. The fuel injection system according to claim 1, wherein a temperature sensor is associated with the intake manifold.

4. The fuel injection system according to claim 1, wherein an engine speed sensor is in communication with the electronic control unit.

5. The fuel injection system according to claim 1, a throttle valve sensor is in communication with the electronic control unit.

6. A method of controlling a fuel injection system, comprising the steps of:

receiving information from a set of sensors;

determining an airflow rate based on information consisting essentially of data received from an airflow meter;

the method further comprising the steps of:

sending a first control signal to the fuel injector when the airflow rate is within a first airflow rate regime and sending a second control signal to the fuel injector when the airflow rate is within a second airflow rate regime; and the first airflow rate regime being lower than the second airflow rate regime; and wherein the first control signal is associated with a speed density control method and the second control signal is associated with an airflow meter control method.

7. The method according to claim 6, wherein the set of sensors includes a pressure sensor associated with the speed density control method.

8. The method according to claim 6, wherein the set of sensors includes an ambient pressure sensor associated with the speed density control method.

9. The method according to claim 6, wherein the set of sensors includes a temperature sensor associated with the speed density control method.

10. The method according to claim 6, wherein the set of sensors includes an air flow meter associated with the airflow meter control method.

11. The method according to claim 6, wherein the airflow meter control method may be optimized for various airflow rates.

12. The method according to claim 6, wherein the airflow meter control method may be optimized for high airflow rates.

13. A method of selecting an injection control method, comprising the steps of:

dividing a range of possible airflow rates into a first airflow rate regime, a second airflow rate regime and a third airflow rate regime, the second airflow rate regime being disposed between the first airflow rate regime and the third airflow rate regime;

associating a first fuel injection control method with the first airflow rate regime and the third airflow rate regime;

associating a second fuel injection control method with the second airflow rate regime;

determining an airflow rate based on information received by a set of sensors;

sending a first control signal associated with the first fuel injection control method to the fuel injector when the airflow rate is within the first airflow rate regime or the third airflow rate regime; and sending a second control signal associated with the second fuel injection control method to the fuel injection when the airflow rate is within the second airflow rate regime.

14. The method according to claim 13, wherein the first airflow rate regime is a low airflow rate regime.

15. The method according to claim 14, wherein the third airflow rate regime is a high airflow rate regime.

16. The method according to claim 13, wherein the first fuel injection control method is a speed density control method.

17. The method according to claim 13, wherein the second fuel injection control method is an airflow meter control method.

18. The method according to claim 13, wherein the set of sensors includes a pressure sensor, a temperature sensor and an ambient pressure sensor associated with the speed density control method.

19. The method according to claim 13, wherein the set of sensors includes an airflow meter associated with the airflow meter control method.

20. The method according to claim 13, wherein the airflow meter control method may be optimized for high airflow rates.

21. A fuel injection system associated with an engine, comprising:

a fuel injector;

an electronic control unit in communication with an airflow meter and in communication with a pressure sensor associated with an intake manifold of the engine;

the electronic control unit also receiving information related to an airflow rate of the engine;

the electronic control unit dividing a range of possible airflow rates into a first airflow rate regime, a second airflow rate regime and a third airflow rate regime, the second airflow rate regime being disposed between the first airflow rate regime and the third airflow rate regime;

the electronic control unit using the pressure sensor associated with the intake manifold in the first airflow rate regime and the third airflow rate regime; and wherein the electronic control unit uses the airflow meter in a second air flow rate regime.

* * * * *